US009696646B2

(12) United States Patent
Liu et al.

(10) Patent No.: US 9,696,646 B2
(45) Date of Patent: Jul. 4, 2017

(54) SUSPENSION POLYMERIZATION TONER OF CORE-SHELL STRUCTURE WITH DENSE CHARGES AND PREPARATION METHOD

(71) Applicant: SHENZHEN LEPUTAI TECHNOLOGY CO., LTD, Shenzhen, Guangdong (CN)

(72) Inventors: Zhijun Liu, Shenzhen (CN); Yuanyuan Zhang, Shenzhen (CN); Huan Zhang, Shenzhen (CN); Xiao Yuan, Shenzhen (CN); Hong Meng, Shenzhen (CN); Hui Yang, Shenzhen (CN)

(73) Assignee: SHENZHEN LEPUTAI TECHNOLOGY CO., LTD, Shenzhen (CN)

( * ) Notice: Subject to any disclaimer, the term of this patent is extended or adjusted under 35 U.S.C. 154(b) by 12 days.

(21) Appl. No.: 14/655,741

(22) PCT Filed: Apr. 1, 2013

(86) PCT No.: PCT/CN2013/073561
§ 371 (c)(1),
(2) Date: Sep. 18, 2015

(87) PCT Pub. No.: WO2014/101357
PCT Pub. Date: Jul. 3, 2014

(65) Prior Publication Data

US 2016/0033887 A1 Feb. 4, 2016

(30) Foreign Application Priority Data

Dec. 27, 2012 (CN) ..... 2012 1 0580669

(51) Int. Cl.
*G03G 9/093* (2006.01)
*G03G 9/13* (2006.01)
*G03G 9/08* (2006.01)

(52) U.S. Cl.
CPC ..... *G03G 9/09321* (2013.01); *G03G 9/0806* (2013.01); *G03G 9/0819* (2013.01); (Continued)

(58) Field of Classification Search
CPC ..... G03G 9/09321; G03G 9/0827; G03G 9/0819; G03G 9/0806; G03G 9/09328; G03G 9/09392; G03G 9/09371
See application file for complete search history.

(56) References Cited

U.S. PATENT DOCUMENTS

2008/0182190 A1* 7/2008 Arakawa ..... G03G 9/0825 430/108.7
2009/0246673 A1* 10/2009 Jung ..... G03G 9/09321 430/110.2

FOREIGN PATENT DOCUMENTS

CN 1707366 A 12/2005
CN 101427186 A 5/2009
CN 101473274 A 7/2009

OTHER PUBLICATIONS

International Search Report of PCT Patent Application No. PCT/CN2013/073561 issued on Oct. 10, 2013.

* cited by examiner

*Primary Examiner* — Thorl Chea

(57) ABSTRACT

Suspension polymerization toner of a core-shell structure with dense charges comprises core-shell composite particles prepared by mixing suspension dispersion liquid of toner core particles with shell monomer emulsion and resin-type CCA dispersion liquid, and carrying out a polymerization reaction to form rigid shell layers with dense charges coated (Continued)

on the soft toner core particles. A preparation method thereof comprises: mixing a low-Tg monomer oil phase forming toner core particles with aqueous dispersion liquid, carrying out a heating polymerization reaction after suspension granulation to convert monomer oil droplet particles to polymer particles, and obtaining soft toner core particles; adding a high-Tg shell monomer forming rigid shell layers into water containing a surfactant to form emulsion, adding the emulsion and CCA dispersion liquid into suspension dispersion liquid of the soft toner core particles for second polymerization after mixing, and cleaning, filtering, drying and performing additive treatment.

12 Claims, 2 Drawing Sheets

(52) U.S. Cl.
CPC ..... *G03G 9/0827* (2013.01); *G03G 9/09328* (2013.01); *G03G 9/09371* (2013.01); *G03G 9/09392* (2013.01)

SUSPENSION POLYMERIZATION TONER OF CORE-SHELL STRUCTURE WITH DENSE CHARGES AND PREPARATION METHOD

TECHNICAL FIELD

The present patent application is related to toner manufacturing, and more particularly, to the suspension polymerization toner of core-shell structure with dense charges prepared by a suspension polymerization process to develop electrostatic charge image and a preparation method thereof.

BACKGROUND

Toner is a developer material for a laser printer or a copy. The operation of a printer is substantially as follows: after exposure, an electrostatic latent image can be formed on the surface of a photosensitive drum charged uniformly. The toner charged by a developing roller and a blade can develop the electrostatic latent image on the surface of the photosensitive drum to form an image. Attracted by opposite charges on the surface of a paper, the image on the surface of photosensitive drum can be transferred and printed on the paper. Then we will get the desired printed image fixed by a heating roller and a pressure roller.

It can be seen from the printing process described above that the toner is charged by the developer roller and the blade, and the charges are obtained by the surface of the toner. The charged toner can develop on the surface of the photosensitive drum to form a pattern to be printed. In order to enable the toner to have good chargeability, a charge control agent (CCA) is required to be dispersed on the surface of the toner particles as uniformly as possible. Before being transferred and printed from the photosensitive drum to the paper, the toner is required to hold charged state continuously. If the charging characteristic and charge retention capacity of the toner is not good, it is difficult to develop or transfer print. It is also difficult to get the image with desired printing effect.

Similarly, the toner should have a number of other properties, such as excellent transfer printing property, low-temperature fixation and storage stability. The toner with a good spherical shape has a high transfer printing efficiency, which can be easily transferred and printed from the photosensitive drum to the paper, while reducing or preventing toner remained on the surface of the photosensitive drum. To reduce the environmental impact, the toner should fix on the paper at a temperature as low as possible. At the same time, the toner should have a good storage stability without melt adhesion even exposed to an high temperature condition during being handled or transported. The toner of core-shell structure improves its fixation property by a core with a low glass-transition temperature (low Tg), and enhances blocking resistance by a shell with a high glass-transition temperature (high Tg), By employing such a layer structure, it is possible to meet requirements of both low-temperature fixation and storage stability.

Conventional mechanical pulverizing toner can be obtained by melting and blending resin, CCA, pigment and wax, then pulverizing and classifying. Since mechanical pulverizing toner has an irregular shape, the pressure applied by the blade to each toner particles varies, and CCA tends to form a phase separated from a binder resin. CCA particles exposed on the surface of the toner can easily fall off. Therefore, mechanical pulverizing toner is non-uniformly charged and has a very wide charges distribution. Chinese Patent CN101427186 provides a mechanical pulverizing toner based on styrene/acrylate and polyester binder resin, using a charge control agent of styrene/acrylate which has a good compatibility with the toner. Therefore, distribution uniformity and retention capacity of charges of the toner has been greatly improved. But it is difficult to meet the requirements of low-temperature fixation. Further, the process in which the toner particles are collided with one another in 5 to 20 minutes for purpose of spheronization at 75 to 100 m/s linear velocity consumes large energy and has high requirement for equipments. Furthermore, it is difficult to get a positive spherical toner.

Compared with traditional mechanical pulverizing toners, the conventional suspension polymerization toner of core-shell structure with dense charges can be obtained by dispersing CCA and waxes, pigments and other components together into a monomer uniformly, and carrying out polymerization after high-speed shearing and granulation. CCA in the toner particles uniformly disperse, and the toner particles have a good sphericity. Thereby, it has a good uniformity of charge distribution and transfer printing efficiency. But the method can result in a significant amount of CCA distributed in the central region of the toner particles. Charges of the toner can be generated by the friction between the blade and the CCA on the surface of the toner. However the CCA dispersed in the central region of toner particles does not involve in such a friction, it can result in an inefficient use of the CCA. Therefore, there is a need to develop an effective method for increasing the charge density on the surface of the toner.

Chinese Patent CN101473274 provides a toner of core-shell structure which comprises a rigid and thin shell layer with dense CCA distributing formed by coating the surface of the toner core particles which is prepared by suspension polymerization process with CCA, using a polymer formed by polymerization reaction of the shell monomer components. The method demands the particle diameter distribution of CCA being used be tightly controlled. It results in a large number of CCA dissociating because a poor compatibility of CCA and shell resin.

Another Chinese patent CN1707366 provides a toner of core-shell structure with positive charges which comprises a surface layer with dense charges having a thickness of about 20-200 nm formed by polymerizing a monomer containing amine or ammonium salt on the surface of the toner core particles, or salting out, melting and bonding with a polymer particle containing amine or ammonium salt. However, it is not easy to obtain a toner particle with positive spherical shape in this way.

SUMMARY

The present patent application aims to overcome deficiencies of the prior art described above, and to provide a suspension polymerization toner of core-shell structure with dense charges which has a good charging property and high charge stability with a regular and uniform shape.

The present patent application provides a suspension polymerization toner of core-shell structure with dense charges which comprises core-shell composite particles prepared by mixing suspension dispersion liquid of soft toner core particles with shell monomer emulsion and CCA dispersion liquid, and carrying out a polymerization reaction to form rigid shell layers with dense charges coated on the soft toner core particle. The weight ratio of the rigid shell layer of the core-shell composite particles to the soft core particle is 20:80-1:99. The average thickness of the rigid shell layers is 0.05-0.2 μm, and the coverage rate of the rigid shell layer on the surface of the soft core particles is greater than 50%. The average particle diameter of the core-shell composite particles prepared by this method is 5-10 μm, and the average sphericity of the particles is 0.950-0.995.

The present patent application also provides a method for preparing a suspension polymerization toner of core-shell structure with dense charges described above. The method includes the following steps of: (1) preparing a low-Tg monomer oil phase forming the toner core particles and aqueous dispersion liquid for dispersing the low-Tg monomer oil phase respectively;

(2) mixing the monomer oil phase with the aqueous dispersion liquid, transferring the mixture into a reactor after high-speed shearing and suspension granulation, carrying out a first polymerization reaction to convert monomer oil droplet particles to polymer particles completely, and obtaining soft toner core particles;

(3) adding a high-Tg shell monomer forming a rigid shell layer into water containing surfactant, after carrying out high-speed shearing or ultrasound to form a fine emulsion having an average particle diameter of 50-200 nm, adding the emulsion into the suspension dispersion system including soft toner core particles, then adding resin-type CCA dispersion liquid and water-soluble initiator to carry out a second polymerization, thereby obtaining a rigid shell layer with dense charges;

(4) cleaning a product formed in the second polymerization reaction until the conductivity of a filtrate being no more than 10 μS/cm, after further filtration and dry, carrying out an additive silica treatment, and then obtaining the suspension polymerization toner of rigid shell layer with dense charges.

The present patent application provides a suspension polymerization toner of core-shell structure with dense charges. Since a resin-type CCA has a good compatibility with a toner shell resin, it can be coated on the outer surface of soft toner core particles to form a resin layer with high dense charges, and does not fall off the surface of the toner easily. Therefore, the toner particles eventually formed can have a high electrified amount and good environmental stability, and the toner particles shape is regular and uniform. There is no storage problem while meeting the requirements of fixation at a given temperature.

The suspension polymerization toner prepared by the processing method described above, used in a laser imaging device, has a high transfer printing efficiency and image density. There is no pollution on the surface of the photosensitive drum. As the toner is excellent in imaging property, low-temperature fixation property and transfer printing property, it has a wide prospect of application.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the present technology. Thus, the disclosed technology is not intended to be limited to the examples described herein and shown, but is to be accorded the scope consistent with the claims.

Figure 2:
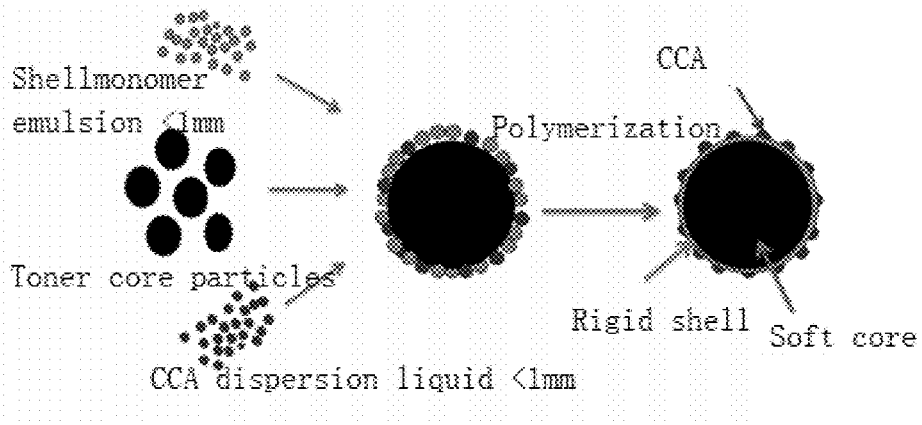
FIG. 2 is a schematic diagram of structure of the prepared suspension polymerization toner particles of core-shell structure with dense charges.

Referring to FIG. 2, the present patent application provides a suspension polymerization toner of core-shell structure with dense charges which comprises core-shell composite particles prepared by mixing suspension dispersion liquid of soft toner core particles with shell monomer emulsion and resin-type CCA dispersion liquid, and carrying out a second polymerization reaction to form rigid shell layers with dense charges coated on the soft toner core particles. Since the resin-type CCA has a good compatibility with toner resin, a resin layer with high dense charges can be formed on the outer surface of the toner uniformly. It does not fall off easily. This can increase charge density of the surface of the toner. A suspension polymerization toner with a good charging characteristic and charge stability can be obtained. At the same time, because of compatibility of resin-type CCA and toner resin, the rigid shell layer of the toner coats toner core particles tightly. Therefore, positive spherical toner particles with regular and uniform shape can be formed.

Specifically, in the suspension polymerization toner of the present patent application, the weight ratio of the rigid shell layer of core-shell composite particles and the soft core particles is 20:80-1:99, preferably 15:80-2:99. The average thickness of the rigid shell layer is 0.05-0.2 μm. The coverage rate of the rigid shell layer on the surface of the soft core particles is greater than 50%, preferably greater than 80%. When the weight ratio of the rigid shell layer of core-shell composite particles and the soft core particles is less than 1:99, the rigid shell layer cannot coat the surface of the soft core particles fully. The adhesion between the toner particles is likely to occur at a higher temperature. It results in a decreased storage stability of the toner. If the weight ratio is greater than 20:80, the rigid shell layer of the toner is too thick. The temperature which softens the toner will be higher. It results in a reduced firmness of fixation of the toner. It cannot meet requirements of low-temperature fixation.

The present patent application provides the suspension polymerization toner of core-shell structure with dense charges. Since the resin-type CCA has a good compatibility with the toner resin, the average particle diameter of formed core-shell composite particles may be 5-10 μm; and the average sphericity of the particles may be 0.950-0.995. It can have a better image quality than existing equipments.

Figure 1:
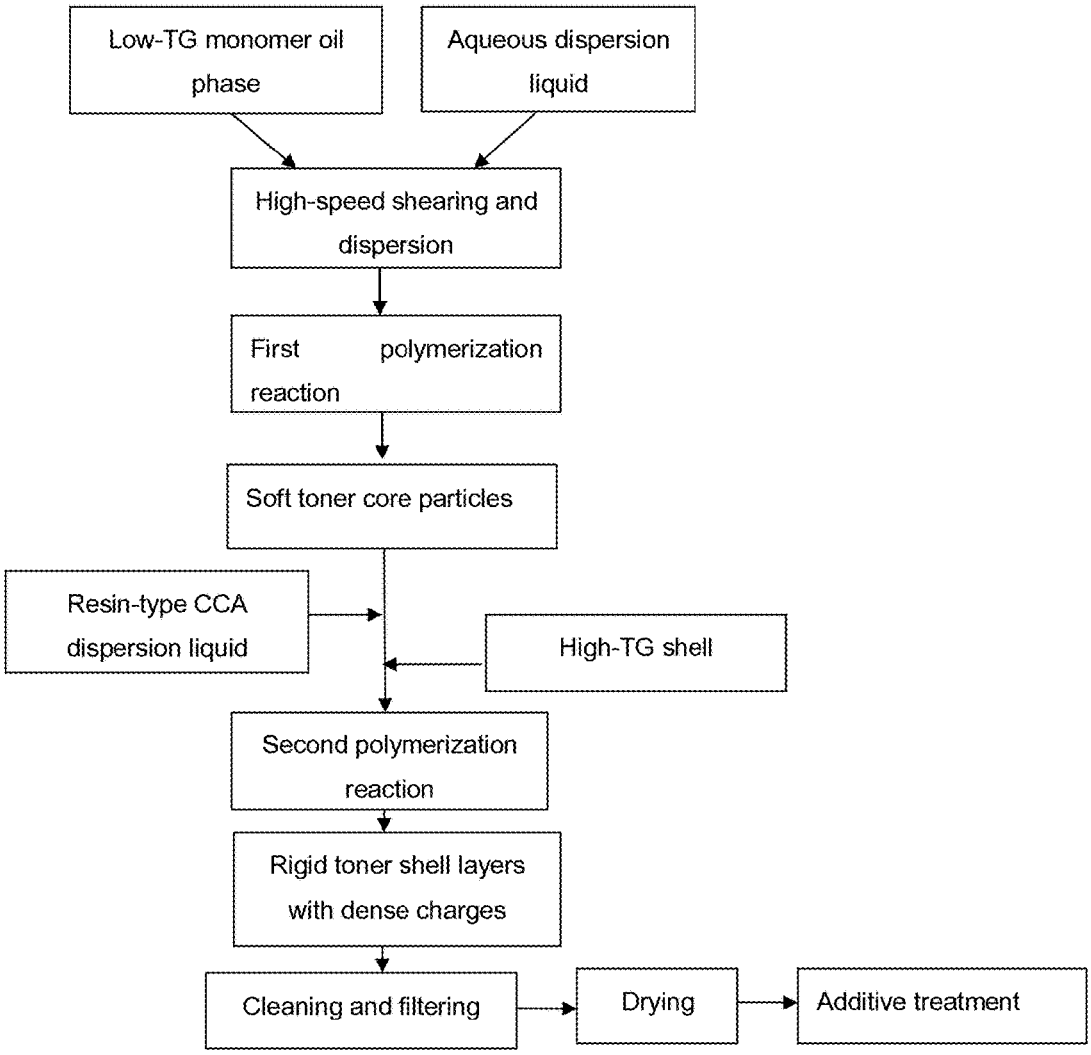
FIG. 1 is a flow chart of the process of the present patent application.

Referring to FIG. 1, a method for preparing a suspension polymerization toner of core-shell structure with dense charges provided by the present patent application includes the following steps of:

(1) preparing a low-Tg monomer oil phase forming the toner core particles and aqueous dispersion liquid for dispersing the low-Tg monomer oil phase respectively;

(2) mixing the monomer oil phase with the aqueous dispersion liquid, transferring the mixture to a reactor after high-speed shearing and suspension granulation, and carrying out a first polymerization reaction (heating polymerization reaction) to convert monomer oil droplet particles to polymer particles completely, and obtaining the soft toner core particles;

(3) adding a high-Tg shell monomer formed the rigid shell layers into water containing a surfactant, and carrying out high-speed shearing or ultrasound to form a fine emulsion having an average particle diameter of 50-200 nm, and adding the emulsion into the suspension dispersion system including the soft toner particles, and then adding resin-type CCA dispersion liquid and water-soluble initiator to carry out a second polymerization reaction, and obtaining a rigid shell layer with dense charges;

(4) cleaning a product of the polymerization reaction until the conductivity of the filtrate being no more than 10 μS/cm, carrying out a silica additive treatment after further filtration and dry, and then obtaining the suspension polymerization toner of core-shell structure with dense charges.

The suspension polymerization toner of core-shell structure with dense charges prepared by the method described above has an excellent imaging property, low-temperature fixation property and transfer printing property.

Details of the step described above will be described as follows.

1. Preparation of Monomer Oil Phase

The components of the toner core particles include a soft core resin, a colorant and a release agent.

The preparation process of the monomer oil phase includes the following steps: adding the colorant, the release agent into a monomer forming the soft core resin monomer, after uniformly grinding and dispersing with a sand mil, further adding a crosslinker, a molecular weight regulator and an initiator to prepare a monomer oil phase.

The monomer forming the toner soft core resin monomer of the present patent application can be primarily selected from mono vinyl monomers. It includes one or more material of the following: styrene, methyl styrene or α-methyl styrene and the like of vinyl aromatic monomer; (methyl) acrylic acid, (methyl) methacrylate, (methyl) ethyl acrylate, (methyl) propyl acrylate, (methyl) butyl acrylate, cyclohexyl methacrylate, (methyl) glycidyl methacrylate, hydroxyethyl methacrylate or lauryl methlacrylate and the like of acrylate acid-type monomer. The resin component accounts for 40-90% of the toner. It has a decisive influence on the fixation property of the toner. In the preparing process, if the glass-transition temperature (Tg) of the toner core resin is too low, the toner can be adhered to the heating roller during printing. It causes thermal offset problems. If the glass-transition temperature (Tg) of the toner core resin is too high, it cannot be fully melted during printing. It results in a pool firmness of fixation of the toner on the paper. Therefore, the glass transition temperature of the toner core resin is preferably 40-60° C.

The colorant of the present patent application includes at least one material of black pigment, yellow pigment, cyan pigment and magenta pigment. The black pigment can be primarily selected from carbon black pigment having the primary particles diameter of 20-40 nm, such as MA-100 (Mitsubishi Chemical Co., Ltd.) #44 (Mitsubishi Chemical Corporation), #52 (Mitsubishi Chemical Corporation), MA7 (Mitsubishi Chemical Corporation), REGAL 300R (Cabot Corporation), REGAL 330R (Cabot Corporation), REGAL 400R (Cabot Corporation), MOGUL L (Cabot Corporation). The cyan pigment can be primarily selected from copper phthalocyanine compounds and derivatives thereof, such as C.I. Pigment Blue 15, 15:1, 15:2, 15:3, 15:4 and the like. The magenta pigment can be primarily selected from azo pigments such as C.I. Pigment Red 31, 48, 57, 58, 63, 68, 114, 122, 146, 150, 163, 187 and 206 and the like. The yellow pigment can be primarily selected from azo pigments, such as C.I. Pigment Yellow 3, 12, 13, 17, 65, 74, 83, 97, 155, 180, 185 and 186 and the like. The amount of the pigment described above is generally 1-30 wt % of the soft core resin monomer, preferably 1-15 wt %.

The release agent used in the present patent application is primarily selected from one or more material of low molecular weight polyolefin waxes and grease-type synthetic waxes. The polyolefin waxes include polyethylene wax (PE wax) and polypropylene wax (PP wax). The grease-type synthetic waxes include pentaerythrityl tetrastearate, pentaerythritol tetrabehenate, dipentaerythritol hexadipalmitate, dipentaerythritol hexamyristate or dipentaerythritol hexalaurate and the like. The grease-type synthetic waxes or polyolefin waxes which have a hydroxyl value of less than 5 mgKOH/g and an acid value of less than 1 mgKOH/g is preferable. It has a melting point in the range of 50-100° C., preferably 60-80° C. The amount of release agent is generally 1-40 wt % of the soft core resin monomer, preferably 2-20 wt %.

The crosslinker of the present patent application can be primarily selected from two or more monomers of unsaturated vinyl groups. It includes one or more material of the following: divinylbenzene, divinyl ether, divinylsulfone, ethylene glycol dimethacrylate, triethylene glycol diacrylate, triethylene glycol dimethacrylate, 1,4-butanedioldimethacrylate BDDMA, 1,6-hexanediol dimethacrylate, trimethylolpropane triacrylate, trimethylolpropane trimethacrylate, pentaerythritol triacrylate or the like. The crosslinker can be used with a mono vinyl monomer together to improve the anti-high-temperature offset property of the toner effectively. The amount of the crosslinker accounts for 0.05-1 wt % of the soft core resin monomer. If the amount is too high, the firmness of the toner fixation will be decreased.

The molecular weight regulator of the present patent application includes one or more material of the following: 1-dodecanethiol, t-dodecyl mercaptan, carbon tetrachloride or carbon tetrabromide, and etc. The amount of the molecular weight regulatro is generally 0.01-5 wt % of the soft core resin monomer, preferably 0.1-1 wt %. The molecular weight regulator (chain transfer agents) of the present patent application improves the firmness of the toner preferably. The over dosage causes the decrease of anti-high-temperature offset property and storage property.

The initiator of the present patent application used to polymerize the toner soft core resin monomer (first polymerization reaction) is an oil-soluble initiator. Because oil-soluble initiator can be well dissolved in the soft core resin monomer, it can uniformly distribute in each oil droplet particles. There is almost no difference of resin molecular weight size and distribution among the soft toner core particles obtained from polymerization reaction. The oil-soluble initiator used in suspension polymerization includes azo-type initiator and peroxide-type initiator. The azo-type initiator includes 2,2'-azobisisoheptonitrile, 2,2-azobis, 2,2'-azobis-(2-methylbutyronitrile), dimethyl 2,2'-azobis(2-methylpropionate) and the like. The peroxide-type initiator includes benzoyl peroxide (BPO), dilauroyl peroxide (LPO), tert-Butyl peroxy-2-ethylhexanoate, tert-Butyl peroxy diethyl acetate, tert-butylperoxyisobutyrate and the like. The oil-soluble initiator can be one or more material as described above. The amount of the oil-soluble typically is 0.01-20 wt % of the soft core resin monomer, preferably 0.1-10 wt %.

2. Preparation of an Aqueous Dispersion Liquid:

The suspension dispersant used in the preparation of the aqueous dispersion liquid can be selected from one or more material of the following: calcium phosphate, magnesium hydroxide, calcium carbonate, polyvinyl alcohol, and hydroxypropyl methyl cellulose. The dispersion stabilizer which contains a water-insoluble inorganic magnesium hydroxide colloid is preferable. Using such dispersant, polymer particles having a narrow distribution of particles diameter can be obtained. There is a small residual resistance after cleaning. Vivid images can be represented.

Specifically, the preparation process of magnesium hydroxide colloid is as follows: disposing magnesium chloride solution and sodium hydroxide solution with deionized water respectively; then adding the magnesium chloride solution into the sodium hydroxide solution slowly, carrying out high-speed shearing and emulsification with a high-speed emulsifier or pipelined emulsion pump or a combination of both, at a high shear line speed of 25-45 m/s, high-speed shearing time 0.5-2 h, ultrasonic aging time 1-5 h. The prepared particle diameter D95 of magnesium hydroxide (cumulative value of the number of particle diameter distribution of 95%) is less than 0.8 μm.

3. Process of Suspension Granulation

Suspension granulation stage is a crucial step of the process for preparing toner by suspension polymerization method. It can directly affect the particle diameter and distribution of the toner.

In the present patent application, the process includes the following steps: stirring and blending a low-Tg monomer oil phase and aqueous dispersion liquid with oil-water ratio of 1:2-1:8, and shearing and granulating mixture of oil and water via a high-speed emulsifier and high-shear emulsification pump after forming primary oil droplet particles. By this time, the oil droplet particle diameter distribution should range from 3 μm to 20 μm, preferably 5-15 μm. The temperature of suspension granulation is preferably 20-60° C.

In the process described above, apparatus for shearing and dispersion can be selected from intermittent Ultratalax T50 (manufactured by IKA Corporation), Clearmix CLM-0.8S (manufactured by M-Technique Corporation.); Continuous Process Pilot 2000 (manufactured by IKA Corporation), and etc. The desired average particle diameter can be achieved by adjusting the speed of shearing. The speed of suspension shearing and granulation may range from 6000 rmp to 25000 rmp. The line speed of high shearing may range from 15 m/s to 40 m/s.

In the present patent application, the concentration of the dispersant in the aqueous dispersion liquid is preferably 0.5-5 wt % of the weight of water or the amount of dispersant of the dispersion liquid accounts for 1-20 wt % of the low-Tg monomer oil phase. If the concentration of dispersant is too low or the amount of dispersant is too small, dispersion structure will be unstable, and oil droplet particles are prone to gather, which results in a broadened distribution of particles diameter. If the concentration of dispersant is too high or the amount of dispersant is excessive, it is easy to produce large amounts of latex particles during high-speed shearing. It is likely to cause background contamination during printing.

4. Process of Polymerization (1) Preparation of Toner Soft Core Particles

The preparation includes the following steps: transferring the oil droplet suspension liquid to a polymerization reactor after performing the step of suspension granulation described above, keeping the stirring speed at 50-1000 rpm, preferably 100-300 rpm, heating to a predetermined temperature of the first polymerization reaction after adding nitrogen and removing oxygen. After polymerization which is continued for a certain period, the oil droplet particles can be converted to polymer particles completely to form a suspension dispersion liquid of the toner soft core particles. In the process, the polymerization temperature is preferably 60-95° C. The polymerization time is 2-20 hours, preferably 4-15 hours.

(2) Preparation of Rigid Shell Layers with Dense Positive Charges

The preparation includes the following steps: adding high-Tg monomer into water containing a surfactant, carrying out high-speed shearing or ultrasound to form fine emulsion having an average particle diameter of 50-200 nm, adding the emulsion into the suspension dispersion system of the soft toner core particles, then adding resin-type CCA dispersion liquid having an average particles diameter of 10-150 nm and an aqueous initiator to carry out the second polymerization reaction, thereby obtaining a rigid shell layer with dense charges.

The weight ratio of the rigid shell layer and the soft toner core particle is preferably 15:80-2:99. The average thickness of the shell layer resin is preferably 0.05-0.2 μm. The coverage rate of the rigid shell layer on the surface of the toner soft core particles is greater than 50%, preferably greater than 80%. Within such ranges, the toner can have both storability and low-temperature fixation.

In the preparation process of the present patent application, the high-Tg monomer forming rigid shell layers can be selected from one or more material including styrene, methacrylate and the like polymers monomer which has a glass-transition temperature greater than 80° C.

The resin-type CCA dispersion liquid can be obtained by dissolving resin-type CCA in organic solution such as ethyl acetate, acetone, 2-butanone, methylbenzene, dimethylbenzene and the like, carrying out emulsification with an emulsifier or nano-high pressure homogenizer after adding water or alcohol, volatilizing the organic solution by heating and adding nitrogen, eventually obtaining the CCA resin dispersion liquid having an average particle diameter of 10-150 nm, and preferably having an average particle diameter of 20-100 nm.

Specifically, the resin-type CCA is selected from a homopolymer or copolymer of sulfonic acid group or a quaternary ammonium salt group. It has a good compatibility with the toner binder resin. Commercially available positive resin CCA can be primarily selected from one or more material of the following: FCA-201-PS (Fujikura Kasei Co.), FCA-207-PS (Fujikura Kasei Co.). The negative charge resin CCA can be primarily selected from one or more material of the following: FCA-1001-NS (Fujikura Kasei Co.), FCA-3001-NL (Fujikura Kasei Co.), FCA-2541 (Fujikura Kasei Co.).

Specifically, the surfactant is preferably an anionic surfactant selected from one or more material of the following: dodecanoic acid, sodium oleate, sodium stearate, octyl sulfate, lauryl sulfate; lauryl sulfate, sodium dodecyl benzene sulfonate, 1-dodecane sulfonic acid sodium salt. The amount of the anionic surfactants accounts for 0.1-5 wt % of the rigid shell layer monomer. If the amount of the emulsifier is too small, the particles diameter of emulsion will be too large. It is relatively difficult to be adsorbed on the surface of the toner soft core particles. If the amount of emulsifier is excessive, it is easy to form a large number of free latex particles.

The polymerization initiator served to polymerize the toner rigid shell layer monomer is preferably a water-soluble initiator. Since the free radicals of water-soluble initiator can easily move to the surface of the toner soft core particles which is absorbed by the rigid shell layer monomer, it is easy to obtain the toner particles of core-shell structure. The water-soluble initiator in the present patent application can be selected from a group consisting of potassium persulfate, ammonium persulfate, 2,2'-azobis(2-methyl-N-(2-hydroxyethyl)propionamide), 2,2'-azobis(2-methyl-N-(1,1-bis(hydroxymethyl)-2-hydroxyethyl)propionamide). The amount of the water-soluble initiator accounts for 0.5-40 wt % of the rigid shell layer monomer, preferably 1-30 wt %.

During carrying out the second polymerization reaction, the polymerization temperature for preparing the shell preferably is 60-95° C. The polymerization time is 2-10 hours, preferably 3-8 hours.

Further, in the preparation of the rigid shell layer, the crosslinker can be added in order to increase the efficiency of the shell resin coating the toner soft core particles and the hardness of the shell. The crosslinker can be selected from one or more material of the following: divinylbenzene, divinyl ether, divinylsulfone, ethylene glycol dimethacrylate, triethylene glycol diacrylate, triethylene glycol dimethacrylate, 1,4-Butanedioldimethacrylate BDDMA, 1,6-hexanediol dimethacrylate, trimethylolpropane trimethacrylate, trimethylolpropane trimethacrylate, pentaerythritol triacrylate, and etc. The amount of the crosslinker accounts for 0.05-5 wt % of the rigid shell layer monomer, Over dosage can cause decrease of firmness of fixation of the toner.

5. Process of Filtrating/Cleaning

In the process, when a colloidal inorganic compound is used as a dispersion stabilizer, after adding acid, the pH value of the suspension liquid of the toner particles obtained from polymerization preferably is less than 6.5 to dissolve the colloidal inorganic compound which is difficult to be dissolved by water. As acid needs to be added, the sulfuric acid (preferable) hydrochloric acid and nitric acid and organic acid can be used. Then, cleaning with a large number of deionized water can be repeated. The filtering method includes centrifugation filtration, vacuum filtration, pressure filtration, and etc.

6. Process of Dry

The process is used to dry the toner particles which have been carried out cleaning treatment. The dryer for drying treatment for the toner can be a vacuum freeze dryer, vacuum dryer, fluidized bed dryer and the like. In order to prevent toner particles from adhering, the temperature for dry preferably is lower than 50° C.

7. Process of External Additive

The process is used to add an external additive to the toner particles after carrying out the drying process.

Chargeability, fluidity and storage stability of the toner particles can be adjusted by attaching or burying external additive into the surface of toner particles.

The external additive for toner can be selected from one or more material of the following: silica, alumina, titanium oxide and other inorganic particles and the like. The particles of silica and titania dioxide after hydrophobic modification are preferable. The amount of the additive accounts for 0.1-5 wt % of the toner. Henschel mixer and other well-known mixing apparatus can be used to add the additive.

The preparation process of the present patent application will be described further in detail in conjunction with specific embodiments as follows.

In the following embodiments, "parts" means weight parts. Evaluation results of examples of the patent application and compared examples are summarized in Table 1.

Example 1

81 parts of styrene, 19 parts of n-butylacrylate, 0.3 parts of divinylbenzene, 1.0 part of 1-dodecanethiol, 7 parts of carbon black (NP60, manufactured by Degussa Corporation) and 8 parts of ester wax (WE-5, manufactured by Nippon Oil & Fats Co., Ltd.) are dispersed to prepare a monomer oil phase with a bead mill at room temperature. 6 parts of oil-soluble initiator tert-Butyl peroxy diethyl acetate are further added and sufficiently dispersed for 30 minutes.

Additionally, aqueous solution formed by dissolving 13 parts of magnesium chloride with 100 parts of deionized water is slowly added into another aqueous solution formed by dissolving 8.3 parts of sodium hydroxide with 200 parts of deionized water. After shearing and dispersing at high speed for 1 hour, and ultrasonic aging for 4 hours at room temperature. The suspension dispersion liquid of magnesium hydroxide can be obtained. The concentration of magnesium chloride of electrolyte is 1 wt % of water.

The process includes the following steps: adding the prepared monomer oil phase into the magnesium hydroxide suspension dispersion liquid containing magnesium chloride electrolyte; after shearing with a high-speed disperser (Ultratalax T50, manufactured by IKA) at a speed of 9000 rpm for 5 minutes to form primary oil droplet particles having an average particle diameter of 100 μm; then shearing with a high-speed disperser (Ultratalax T50, manufactured by IKA) at a speed of 9000 rpm for 10 minutes, then transferring it to a nitrogen protective reactor, and heating to 90° C. and carrying out polymerization reaction for 8 hours, and obtaining the soft suspension toner core particles having an average particle diameter of 8.0 μm.

The process further includes the following steps: adding 10 parts of styrene, 0.3 parts of 1,4-butanedioldimethacrylate into 30 parts of deionized water which dissolved with 0.05 parts of sodium dodecyl benzene sulfonate; emulsifying with a high-speed disperser (Ultratalax T50, the IKA) at a speed of 10000 rpm speed for 5 minutes; adding it into the above suspension dispersion system to disperse for 30 minutes; dissolving 20 parts of the dispersion liquid of the positively charged CCA FCA-201-PS (50 nm, solid content 10 wt %) (styrene-acrylic acid copolymer, manufactured by Japan Proton warehouse Kasei Co., Ltd.) and 2 parts of potassium persulfate dissolved with 10 parts of deionized water; then adding it into the above suspension dispersion system to carry out a polymerization for 5 hours at 90° C.

The process further includes the following steps: removing magnesium from the product of polymerization with sulfate solution, then cleaning with a plenty of deionized water repeatedly until the conductivity is no more than 10 μS/cm; adding 1 part of silica R504 (12 nm, manufactured by Degussa Corporation) and 0.5 parts of silica TG-C190 (30 nm, manufactured by Cabot Corporation) after filter cake being dried. The processed suspension polymerization toner can be obtained. Evaluation results of characteristic of the resulting toner are shown in Table 1 below.

Example 2

The performing procedure of this example is substantially the same with that of Example 1 except changing 10 parts of styrene, 0.3 parts of 1,4-butanedioldimethacrylate and 20 parts of the dispersion liquid of the positively charged CCA FCA-201-PS (50 nm, solid content 10 wt %) to 5 parts of methyl methacrylate, 0.2 parts of divinylbenzene and 5 parts of the dispersion liquid of the positively charged CCA FCA-207P (80 nm, solid content 20 wt %). The suspension polymerization toner of the patent application having an average particle diameter of 8.2 μm can be obtained. Evaluation results of characteristic of the resulting toner are shown in Table 1 below.

Example 3

The performing procedure of this example is substantially the same with that of Example 1 except changing 7 parts of carbon black (NP60, manufactured by Degussa Corporation) to 6 parts of Pigment Blue 15:3 (manufactured by Clariant). The suspension polymerization toner of the present patent application having an average particle size of 8.0 μm can be obtained. Evaluation results of characteristic of the resulting toner are shown in Table 1 below.

Compared Example 1

81 parts of styrene, 19 parts of n-butylacrylate, 0.5 parts of divinylbenzene, 1.0 part of 1-dodecanethiol, 2 parts of positively charged CCA FCA-201-PS, 7 parts of carbon black (NP60, by Degussa Corporation) and 8 parts of ester wax (WE-5, manufactured by Nippon Oil & Fats Co., Ltd.) are dispersed with a bead mill to prepare the monomer oil phase at room temperature. Further, the procedure includes the following: adding 6 parts of oil-soluble initiator of tert-Butyl peroxy diethyl acetate, and sufficiently dispersing for 30 minutes.

The process further includes the following steps: additionally, adding aqueous solution formed by dissolving 13 parts of magnesium chloride with 100 parts of deionized water into another aqueous solution formed by dissolving 8.3 parts of sodium hydroxide with 200 parts of deionized water; shearing at a high speed for 1 hour; and ultrasonic aging for 4 hours at room temperature. The suspension dispersion liquid of magnesium hydroxide can be obtained, in which the concentration of the remained electrolyte of magnesium chloride is 1 wt % of water.

The process further includes the following steps: adding the prepared monomer oil phase into the suspension dispersion liquid of magnesium hydroxide containing magnesium chloride electrolyte; shearing with a high-speed disperser (Ultratalax T50, manufactured by IKA) at a speed of 3000 rpm for 5 minutes to form primary oil droplet particles having an average particles diameter of 100 μm; then shearing with a high-speed disperser (Ultratalax T50, manufactured by IKA) at a speed of 9000 rpm for 10 minutes; then transferring it to a nitrogen protective reactor and heating to 90° C. to carry out a polymerization for 12 hours. The suspension toner having an average particle diameter of 8.2 μm can be obtained.

The process further includes the following steps: removing magnesium hydroxide from the product of the polymerization with sulfate solution; then repeatedly cleaning with a plenty of deionized water until the conductivity of the filtrate is no more than 10 μS/cm.

The process further includes the following steps: adding 1 part of silica R504 (12 nm, manufactured by Degussa Corporation) and 0.5 parts of silica TG-C190 (30 nm, manufactured by Cabot Corporation) after dry the filter cake. The compared suspension polymerization toner having an average particle diameter of 8.2 μm can be obtained. Evaluation results of characteristic of the resulting toner are shown in Table 1 below.

Compared Example 2

The performing procedure of this example is substantially the same with that of Example 1, except changing 20 parts of the dispersion liquid of the positively charged CCA FCA-201-PS (solid content 10 wt %) to 20 parts of positively charged CCA TP-415 (0.2 μm, solid content 10% wt) (Hodogaya Chemical Co., Ltd.). The compared suspension toner having an average particle diameter of 8.5 μm can be obtained. Evaluation results of characteristic of the resulting toner are shown in Table 1 below.

Compared Example 3

The performing procedure of this example is substantially the same with that of Example 1, except changing 20 parts of the dispersion liquid of positively charged CCA FCA-201-PS (50 nm, solid content 10 wt %) to no parts. The process further includes the following steps: after drying the product of filter cake, carrying out a cover treatment with 1 part of positively charged CCA MP-5500 (0.4 μm, manufactured by Soken Chemical Co., Ltd.); adding 1 part of silica R504 (12 nm, by Degussa Corporation) and 0.5 parts of silica TG-C190 (30 nm, manufactured by Cabot Corporation) to process. The compared suspension polymerization toner having an average particle diameter of 8.4 μm can be obtained. Evaluation results of characteristic of the resulting toner are shown in Table 1 below.

Evaluation Methods of Toner:

(1) Particle Diameter Distribution of Toner

The volume average particle diameter of the toner particles forming the present patent application is preferably 5-9 μm. As the volume average particle diameter is in the above range, it improves transfer printing efficiency, image quality involving thin lines, spots and the like.

Specific measurement method is as follows: weighting and measuring about 0.1 g the toner particles; placing it in a beaker; adding 0.01 g sodium dodecylbenzenesulfonate and 30 ml deionized water; dispersing it in a dispersion of 60 W ultrasonic for 3 minutes; measuring the number of particles using a coulter particle counter (Multisizer3, manufactured by Beckman Co.) with the pore size at 100 μm and the number of particles reaches 50,000, and measuring volume average particle diameter (Dv) and mean particle diameter (Dn) to calculate particle size distribution (Dv)/(Dn).

(2) Average Sphericity of Toner Particles

From the viewpoint of improving transfer printing efficiency, the average sphericity of the toner particles forming the present patent application is preferably 0.950-0.995.

Specific measurement method is as follows: adding deionized water into a vessel in advance; adding 0.02 g surfactant of sodium of dodecylbenzene sulfonate; then adding 0.02 g toner particles; dispersing it in a dispersion of 60 W ultrasonic for 3 minutes; adjusting the concentration of the colorant resin particles to 1000-10000/μL during the measurement. A flow-type particle image analyzer (FPIA-2100, manufactured by Sysmex Corporation) is used for measuring. The average sphericity can be calculated from the measurement. The sphericity can be represented by the following formula I, and the average sphericity is the mean value thereof.

Sphericity=Circumference equal to the projected area of the particle/Circumference of projected image of particle — Formula I (3) Electrified Amount The measurement method can be as follows: adding the toner into a color developing device of a commercial printer HL-3040CN; disposing it at the environment of temperature of 23° C. and humidity (N/N) of 50% and at the environment of temperature of 35° C. and humidity of 80% (H/H) for 24 hours respectively; and measuring electrified amount of the toner with Q/M electrified amount tester.

(4) Durability

The measurement method can be as follows: adding the toner into a developing device of a commercially available color printer HL-3040CN, at a temperature of 23° C., 50% humidity (N/N) environment at 5% concentration for continuous printing 5000, each of which performs full-color printing 500; measuring the image density.

(5) Fixation Temperature

Fixing experiments can be carried out using a transformed single component developing printer which can change the temperature of a fixing roller. The fixing test can be carried out as follows: changing the temperature of the printer fixing roller per 5° C.; and measuring the fixing rate of the toner at each temperature. The fixing rate is calculated by the ratio of the image density of printing all black area before and after using the operation of tap stripping. The minimum temperature of the fixing roller at which the fixing rate is greater or equal to 80% can be viewed as the fixation temperature of the toner. If the fixation temperature is low, the toner is suitable for high-speed printing.

(6) Storability

The measurement method can be as follows: adding about 20 g toner into a closed container; taking it out after being disposed at an environment of 50° C. for two weeks without destroying the structure as possible; transferring it to a shaker having a mesh size of 500 μm and the amplitude being set to 1.0 mm; measuring the weight of the toner remained on the shaker after shaking for 30 seconds. This weight can be viewed as the weight of the agglomeration toner; and calculating the ratio of the weight of the agglomeration toner with the weight of the toner primarily added into the container. A sample can be measured three times. The average value thereof can be viewed as an indication of the storability. Storability of the toner whose residual rate is small after toner sieving is optimal.

TABLE 1

| | | Example 1 of the application | Example 2 of the application | Example 3 of the application | Compared Example 1 | Compared Example 2 | Compared Example 3 |
|---|---|---|---|---|---|---|---|
| Volume average particle diameter (μm) | | 8.1 | 8.2 | 8.0 | 8.2 | 8.5 | 8.4 |
| Particle diameter distribution ($D_V/D_P$) | | 1.22 | 1.24 | 1.25 | 1.25 | 1.24 | 1.27 |
| Average sphericity | | 0.976 | 0.978 | 0.975 | 0.980 | 0.967 | 0.970 |
| Electrified amount (μC/g) | 23° C., 50RH % | +28.3 | +26.0 | +29.0 | +22.2 | +20.5 | +11.7 |
| | 35° C., 80RH % | +25.6 | +24.5 | +26.8 | +20.6 | +16.9 | +10.4 |
| Print Density | Initial density | 1.54 | 1.52 | 1.57 | 1.55 | 1.43 | 1.06 |
| | After printed 5000 pages | 1.42 | 1.40 | 1.43 | 1.38 | 1.0 | 0.66 |
| Fixation temperature (° C.) | | 130 | 132 | 128 | 105 | 128 | 131 |
| Residual rate after sieving (%) | | 2 | 2 | 3 | 20 | 5 | 5 |

From evaluation results of toner for developing electrostatic charge in Table 1, it can be found that:

The toner of no-core-shell structure of the Compared Example 1 has a poor storability at a high temperature condition. The fluidity of the toner decreases during long-time printing. It results in a reduced electrified amount and transfer printing efficiency.

The surface of the toner of the core-shell structure of Compared Example 2 and Compared Example 3 does not embed or absorb CCA firmly. The CCA is likely to fall off. A white film can be formed on the photosensitive drum. The electrified amount of the toner is reduced. The poor durability of CCA results in a decreased image density.

In contrast, the toner of core-shell structure of Example 1-3 of the present patent application has a high electrified amount, environmental stability, transfer printing efficiency and image density. There is no pollution on the surface of photosensitive drum. It meets the requirement of fixation at a given temperature without storability problem.

Various exemplary embodiments are described herein. Reference is made to these examples in a non-limiting sense. They are provided to illustrate more broadly applicable aspects of the disclosed technology. Various changes can be made and equivalents can be substituted without departing from the true spirit and scope of the various embodiments. In addition, many modifications can be made to adapt a particular situation, material, composition of matter, process, process act(s) or step(s) to the objective(s), spirit or scope of the various embodiments. Further, as will be appreciated by those with skill in the art, each of the individual variations described and illustrated herein has discrete components and features which can be readily separated from or combined with the features of any of the other several embodiments without departing from the scope or spirit of the various embodiments.

What is claimed is:

1. A preparation method of the suspension polymerization toner of core-shell structure with dense charges, comprising following steps:

(1) preparing a low glass-transition temperature (low-Tg) monomer oil phase and aqueous dispersion liquid for dispersing the low-Tg monomer oil phase respectively;

(2) mixing the low-Tg monomer oil phase with the aqueous dispersion liquid, and transferring mixture into a reactor after carrying out high-speed shearing and suspension granulation, then carrying out a first polymerization reaction to convert monomer oil droplet particles to polymer particles completely, and obtaining the soft toner core particles, the preparation process of the monomer oil phase includes the following step: adding the colorant, the release agent into a monomer forming the soft core resin monomer, after uniformly grinding and dispersing with a sand mil, further adding a crosslinker, a molecular weight regular and an initiator to prepare a monomer oil phase, the glass transition temperature of the toner core resin is 40~60° C.;

(3) adding a high glass-transition temperature (high-Tg) shell monomer forming the rigid shell layer into water containing a surfactant, after carrying out high-speed shearing or ultrasound to form a fine emulsion having an average particle diameter of 50-200 nm, adding a emulsion into a suspension dispersion system comprising the soft toner core particles, then adding resin-type charge control agent (CCA) dispersion liquid and a water-soluble initiator to carry out a second polymerization reaction, thereby obtaining the rigid shell layer with dense charges, the high-Tg monomer forming rigid shell layers have a glass-transition temperature greater than 80° C., the resin-type CCA is selected from a homopolymer or copolymer sulfonic acid group or a quaternary ammonium salt group; and (4) cleaning a product formed in the second polymerization reaction until a conductivity of a filtrate being no more than 10 μS/cm, carrying out a silica external additive treatment after a further filtration and dry, then obtaining the suspension polymerization toner of core-shell structure with dense charges.

2. The preparation method for the suspension polymerization toner of core-shell structure with dense charges of claim 1, wherein, in the step (1), the low-Tg monomer oil phase for preparing the toner core particles is formed by adding a colorant, a release agent into a soft core resin monomer, grinding and dispersing uniformly with a sand mill, and adding a crosslinker, a molecular weight regulator and an initiator.

3. The preparation method for the suspension polymerization toner of core-shell structure with dense charges of claim 2, wherein the soft resin monomer is primarily selected from monovinyl monomers comprising one or more material of an aromatic vinyl-based monomer and/or acrylic acid monomers; the colorant is at least one material selected from black pigment, yellow pigment, cyan pigment, magenta pigment; the cyan pigment is selected from copper phthalocyanine compound and derivatives thereof; the magenta pigment is selected from azo pigment, the yellow pigment is selected from the azo pigment; the release agent is one or more compounds selected from grease synthetic waxes and low molecular weight polyethylene wax, polypropylene wax having a hydroxyl value of less than 5 mgKOH/g and an acid value of less than 1 mgKOH/g.

4. The preparation method of the suspension polymerization toner of core-shell structure with dense charges of claim 3, wherein the amount of the colorant is 1-20 wt % of the soft core resin monomer, the black pigment is selected from carbon black pigment having a particle diameter of 20-40 nm; a melting point of wax used as the releasing agent ranges from 50° C. to 100° C., and the amount of the wax is 1-40 wt % of the soft core resin monomer.

5. The preparation method of the suspension polymerization toner of core-shell structure with dense charges of claim 2, wherein the crosslinker is selected from one or more material of following: divinylbenzene, divinyl ether, divinylsulfone, ethylene glycol dimethacrylate, triethylene glycol diacrylate, triethylene glycol dimethacrylate, 1,4-butanedioldimethacrylate, 1,6-hexanediol dimethacrylate, trimethylolpropane triethylene glycol dimethacrylate, trimethylolpropane trimethacrylate, and pentaerythritol triacrylate; and the amount of the crosslinker accounts for 0.05-5 wt % of the soft core resin monomer.

6. The preparation method of the suspension polymerization toner of core-shell structure with dense charges of claim 2, wherein the molecular weight regulator comprises one or more material of following: 1-dodecanethiol, t-dodecyl mercaptan, carbon tetrachloride and carbon tetrabromide, and the amount of the molecular weight regulator is 0.01-5 wt % of the soft core resin monomer.

7. The preparation method of the suspension polymerization toner of core-shell structure with dense charges of claim 2, wherein the initiator is selected from oil-soluble initiators, the amount of the initiator is 0.5-10 wt % of the soft core resin monomer.

8. The preparation method of the suspension polymerization toner of core-shell structure with dense charges of claim 1, wherein in the step (3), the high-Tg shell monomer forming the rigid shell layer is selected from one or more material comprising styrene or methyl propiolate which has a glass-transition temperature over 80° C.

9. The preparation method of the suspension polymerization toner of core-shell structure with dense charges of claim 1, wherein, in the step (3), the CCA resin dispersion liquid is obtained by emulsifying a resin-type CCA with a high-speed mulser or high-pressure nanometer homogenizer, and volatilizing an organic solution after heating and adding nitrogen.

10. The preparation method of the suspension polymerization toner of core-shell structure with dense charges of claim 9, wherein the resin-type CCA is selected from one or more homopolymer or copolymer containing sulfonic acid group or quaternary ammonium salt group, an average particle diameter of the resin-type CCA dispersion liquid is 10-150 nm, wherein the amount of the resin-type CCA is 0.5-10 wt % of the rigid shell layer.

11. The preparation method of the suspension polymerization toner of core-shell structure with dense charges of claim 1, wherein, in the step (3), the surfactant is selected from an anionic surfactant which is one or more material from the group consisting of potassium salt, sodium oleate, sodium stearate, octyl sulfate, lauryl sulfate, sodium dodecyl benzene sulfonate, 1-dodecane sulfonic acid sodium salt; and the amount of the surfactant accounts for 0.1-5 wt % of the rigid shell layer.

12. The preparation method of the suspension polymerization toner of core-shell structure with dense charges of claim 1, wherein in the step (3) the water-soluble initiator used for the second polymerization reaction is selected from a group consisting of potassium persulfate, ammonium persulfate, 2, 2'-azobis (2-methyl-N-(2-hydroxyethyl) propionamide), 2, 2'-azobis (2-methyl-N-(1,1-bis (hydroxymethyl)-2-hydroxyethyl) propionamide); the amount of the water-soluble initiator accounts for 0.5-40 wt % of monomer of the rigid shell layer; a polymerization temperature for forming shell is 60-95° C., and polymerization time is 2-10 hours.

* * * * *